US012728958B1

(12) United States Patent
Gonzalez

(10) Patent No.: US 12,728,958 B1
(45) Date of Patent: Sep. 8, 2026

(54) RETROFITTABLE ANCHOR RETRIEVAL ACCESSORY

(71) Applicant: Noel Juan Gonzalez, Miami, FL (US)

(72) Inventor: Noel Juan Gonzalez, Miami, FL (US)

( * ) Notice: Subject to any disclaimer, the term of this patent is extended or adjusted under 35 U.S.C. 154(b) by 0 days.

(21) Appl. No.: 19/441,270

(22) Filed: Jan. 6, 2026

(51) Int. Cl.
*B63B 21/46* (2006.01)
*B63B 21/22* (2006.01)
*B63B 21/24* (2006.01)
*B63B 21/32* (2006.01)

(52) U.S. Cl.
CPC ..... *B63B 21/46* (2013.01); *B63B 21/22* (2013.01); *B63B 21/24* (2013.01); *B63B 21/32* (2013.01)

(58) Field of Classification Search
CPC ..... B63B 21/00; B63B 21/24; B63B 21/32; B63B 21/46; B63B 21/22
USPC ..... 114/297, 299
See application file for complete search history.

(56) References Cited

U.S. PATENT DOCUMENTS 2,651,277 A * 9/1953 Jenshak ..... B63B 21/44 114/299
5,188,055 A * 2/1993 Kershner ..... B63B 21/46 114/299
2013/0125805 A1* 5/2013 Wood ..... B63B 21/46 114/301

FOREIGN PATENT DOCUMENTS

WO WO-2005123496 A1 * 12/2005 ..... B63B 21/46

* cited by examiner

*Primary Examiner* — Lars A Olson
(74) *Attorney, Agent, or Firm* — Ruben Alcoba, Esq.

(57) ABSTRACT

An anchor retrieval accessory and modification kit for non-permanent attachment to an anchor. The accessory includes a linear bar formed of stainless steel, having a first bar eyelet and a second bar eyelet at opposite ends. The linear bar is secured to an anchor shank via a first shackle and a second shackle. A sliding mount is movably disposed on the linear bar to provide a securing point for a boat rode. In a preferred embodiment, the second end of the linear bar comprises a hooked distal termination extending toward the anchor shank, specifically configured to reduce the assembly profile for fitment within restricted-size anchor wells. This configuration serves as a mechanical stop for the sliding mount and enables immediate, cyclic re-deployment of the anchor without manual reconfiguration of the boat rode or trip lines, facilitating efficient single-handed operation. For use with a plow anchor, the linear bar may further define a curvature with an internal angle between 90 and 160 degrees.

8 Claims, 6 Drawing Sheets

RETROFITTABLE ANCHOR RETRIEVAL ACCESSORY

BACKGROUND OF THE INVENTION

The field of the invention relates to marine anchoring systems, and more particularly to accessories for improving the retrieval of buried or set anchors, such as claw anchors (e.g., Bruce-style) and plow anchors (e.g., CQR or Delta-style).

Claw anchors typically feature a one-piece construction with a shank connected to three curved flukes that dig into varied seabeds, including sand, mud, and gravel. These anchors set quickly and provide reliable holding but can bury deeply, making breakout challenging. Retrieval generally involves motoring forward to position the boat over the anchor, applying vertical pull to rotate the flukes upward, and hauling the anchor aboard. In fouled conditions, users employ trip lines attached to a crown hole or retrieval rings/buoys slid down the rode. Such anchors often include a primary shackle hole at the top end of the shank for rode attachment, and some designs incorporate an additional eyelet or mounting point along the shank for auxiliary purposes.

Plow anchors, whether hinged (CQR) or fixed (Delta), include a shank attached to a single broad, curved fluke that plows into the seabed for strong penetration in soft bottoms. They excel at resetting with directional changes but often bury deeply, requiring similar vertical pull for breakout. Trip lines to the crown or retrieval systems are commonly used when stuck. Like claw anchors, plow anchors typically have a main attachment eyelet at the top of the shank, with certain models featuring a secondary eyelet positioned toward the lower or mid-shank region to support alternative configurations or accessories.

Retrieving either type of anchor can be physically demanding, particularly for single-handed operators or on larger vessels with heavy rodes (chain or rope). Standard attachment occurs at the top shackle hole of the shank, leading to horizontal pull when set and potential difficulty in achieving clean vertical breakout without excessive force or multiple helm-to-bow trips. While slotted shanks exist in some designs to allow sliding attachment points for easier release in fouled conditions, and release devices (e.g., shear-pin bars shifting pull to the crown) address snagged anchors, these are often integrated or specific to fouling scenarios.

Conventional systems lack a simple, retrofittable accessory that provides an alternative, slidable attachment point along an extension above the shank, allowing the rode to connect variably for optimized pull angle during normal retrieval, facilitating easier vertical alignment and reduced effort, especially in solo operation, while maintaining compatibility with existing claw and plow anchors without modifying the anchor itself. Existing approaches do not adequately leverage the potential of dual eyelets on the shank (one at the top end and another strategically placed) to securely mount a linear extension bar via shackles, where the bar itself supports a sliding mount for dynamic rode positioning.

There exists a need for an accessory in the form of a linear bar, which may be flat or circular in cross-section, positioned above the shank and secured via two shackles connecting eyelets at each end of the bar to corresponding eyelets on the shank (one at the top end and one at a suitable lower position). This bar would enable a sliding mount to be positioned along its length, defining a securing point for the boat's chain or rope, which is configured for attachment to a winch on the vessel using the anchor. Such a design would enhance retrieval efficiency by allowing adjustable pull angles, reducing strain on operators and equipment across varied seabeds and conditions.

SUMMARY

The present invention addresses the aforementioned needs by providing a retrofittable anchor retrieval accessory designed for use with claw anchors (e.g., Bruce-style) and plow anchors (e.g., CQR or Delta-style). The accessory comprises a linear bar, which may be flat or circular in cross-section, positioned above the shank of the anchor and secured thereto via two shackles. The bar includes eyelets at each bottom end that align with corresponding eyelets on the shank, one at a first top end of the shank and the other at a second top end of the shank, allowing the shackles to connect the bar to the shank securely without permanent modifications to the anchor (note the anchor has may have be modified to have a pair of top end eyelets at a top side of the shank). A sliding mount is mounted on the bar, defining a securing point for the boat's chain or rope (rode), which is configured for attachment to a winch on the vessel.

This design enables dynamic repositioning of the rode attachment along the bar: during anchoring, the sliding mount can be fixed at the upper end for standard horizontal pull and secure holding, while for retrieval, it slides toward the lower end to shift the pull vector closer to the crown or flukes, promoting a more vertical orientation. A key advantage is the induced change in the center of gravity, elevated and forward during setting for optimal burial, then lowered and rearward during breakout, which facilitates easier dislodgment of deeply buried anchors with reduced physical effort. As a result, the anchor can be retrieved efficiently by a single operator, minimizing the need for multiple helm-to-bow trips or excessive force, particularly on vessels with heavy rodes or in solo sailing scenarios.

Objectives of the invention include enhancing retrieval efficiency across varied seabeds by providing an adjustable pull angle that mimics trip-line functionality without additional lines; improving safety and usability for single-handed users by reducing strain on operators, winches, and equipment; ensuring broad compatibility with existing anchor designs through simple shackle-based installation; and offering a cost-effective, retrofittable solution that requires no anchor modifications while supporting quick adjustments for optimized performance in both setting and breakout modes. Optional features may include locking mechanisms for the sliding mount, corrosion-resistant materials for durability, or integrated indicators for position feedback, further advancing operational reliability in marine environments.

The present invention further provides a significant operational advantage by allowing for immediate, rapid re-deployment of the anchor following retrieval. Unlike traditional trip-line systems that require manual resetting or reconfiguration of lines, the sliding mount configuration allows for multiple anchoring cycles in minutes without the operator needing to leave the helm. Furthermore, in a preferred embodiment, the linear bar includes a hooked distal termination at its second end. This specific geometry ensures the accessory maintains a low profile to fit within restricted-size anchor wells while simultaneously acting as a travel limit for the sliding mount.

DRAWINGS

These and other features, aspects, and advantages of the present invention will become better understood with regards to the following description, appended claims, and drawings where:

DESCRIPTION

Figure 1:
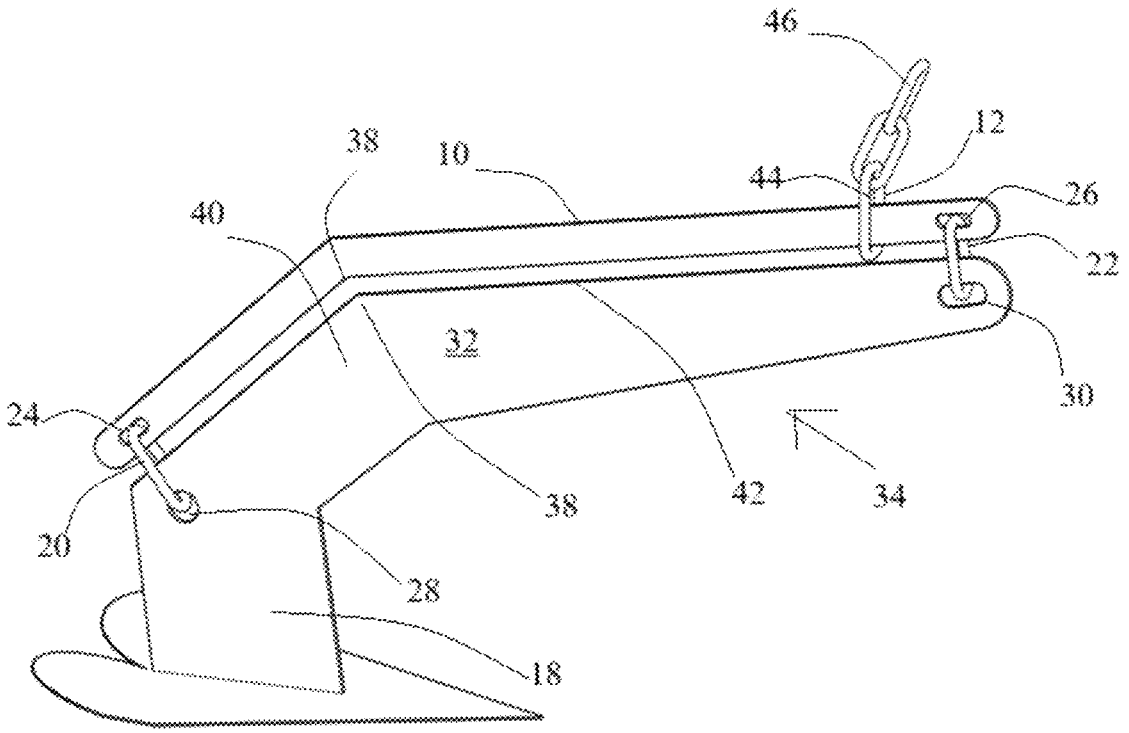
FIG. 1 is a side elevational view of the retrofittable anchor retrieval accessory mounted on a plow anchor, with the sliding mount positioned at the distal end of the linear bar.
Figure 2:
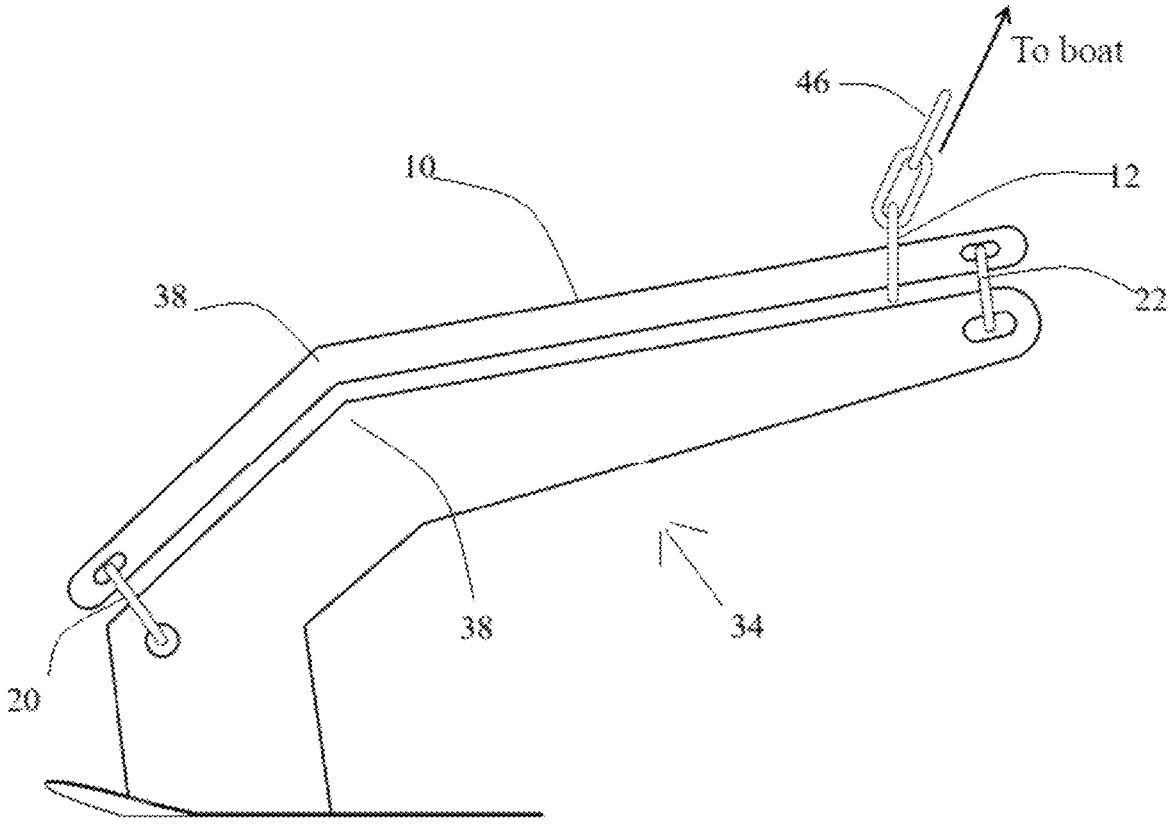
FIG. 2 is a side elevational view of the plow anchor and accessory of FIG. 1 in a retrieval orientation on the seabed, showing the direction of pull toward the boat with the sliding mount at the distal end.
Figure 3:
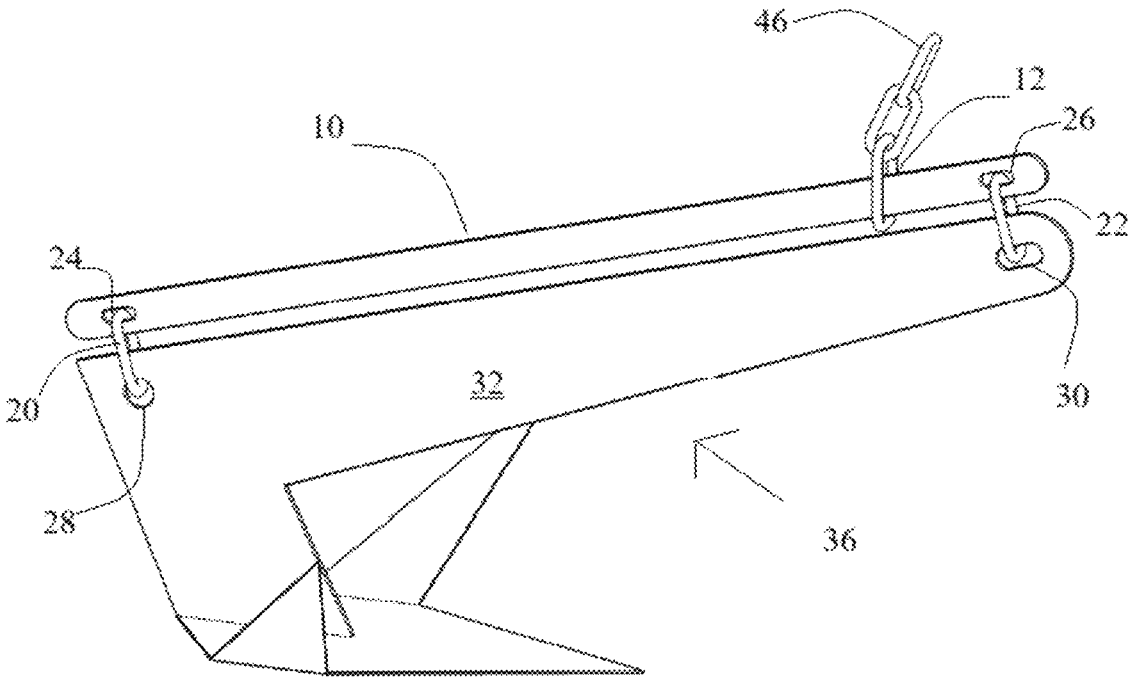
FIG. 3 is a side elevational view of the retrofittable anchor retrieval accessory mounted on a claw anchor, with the sliding mount positioned at the distal end of the linear bar.
Figure 4:
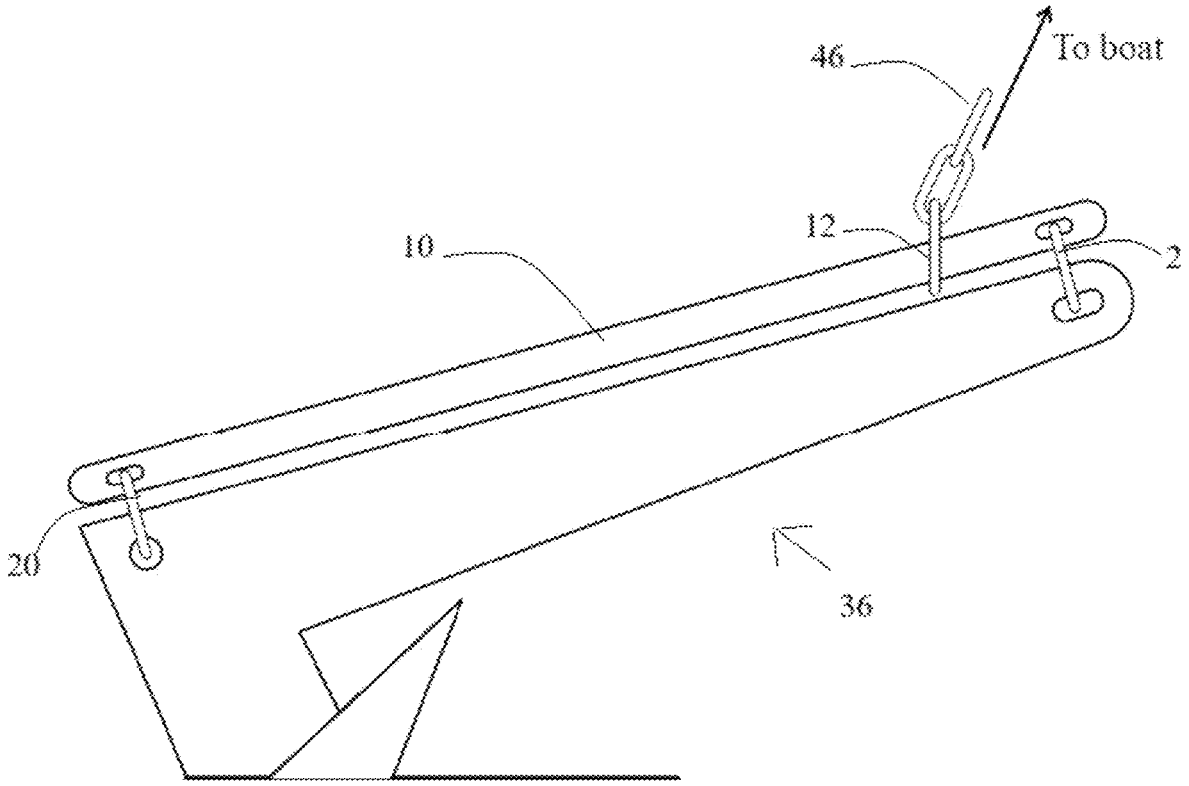
FIG. 4 is a side elevational view of the claw anchor and accessory of FIG. 3 in a retrieval orientation on the seabed, showing the direction of pull toward the boat with the sliding mount shifted to the proximal end.

The following description is directed to an anchor retrieval accessory configured for non-permanent attachment to an anchor. The system is designed to provide a sliding point of pull along the shank of an anchor to facilitate easier retrieval, particularly when the anchor is lodged in a seabed.

As illustrated in the embodiments, the accessory comprises a linear bar 10 constructed from high-tensile stainless steel. The linear bar 10 serves as a track for a sliding mount 12, which is movably disposed thereon. The sliding mount 12 is characterized by a cross-sectional profile that may be substantially rectangular or substantially oval, ensuring a snug yet free-sliding fit over the linear bar 10.

The linear bar 10 is secured to the anchor 18 via a first shackle 20 and a second shackle 22. To facilitate this connection, the linear bar 10 defines a first bar eyelet 24 at its first end and a second bar eyelet 26 at its second end. These bar eyelets are configured to align with a first shank eyelet 28 and a second shank eyelet 30 located on the top side of the anchor shank 32.

Because the anchor 18 may be a plow anchor 34 or a claw anchor 36, the geometry of the linear bar 10 is adaptable. In the embodiment for a plow anchor 34, the linear bar 10 defines a curvature 38. This curvature 38 is specifically engineered to follow the non-linear longitudinal profile of the plow anchor shank 40, defining an internal angle 42 of between 90 degrees and 160 degrees. Conversely, for a claw anchor 36, the linear bar 10 is substantially straight to align with the linear nature of that specific shank.

The sliding mount 12 includes a securing point 44, typically an aperture, which receives the boat rode 46 (such as a chain or rope) connected to a vessel's winch.

The present invention provides several significant technical and operational advantages over fixed-point anchor attachments:

Mechanical Advantage in Retrieval: By utilizing the sliding mount 12 on the linear bar 10, the point of pull automatically shifts as the vessel moves. This allows the winch to exert force from a variety of angles, significantly reducing the torque required to break the anchor 18 free from the seabed.

Non-Permanent Modification: Unlike traditional "trip lines" or welded-on retrieval systems, the use of the first shackle 20 and second shackle 22 allows the accessory to be removed or replaced without compromising the structural integrity of the anchor shank 32.

Durability and Corrosion Resistance: The use of stainless steel for the linear bar 10 ensures that the system remains functional in harsh saltwater environments, preventing the sliding mount 12 from seizing due to rust or biofouling.

Universal Compatibility: The availability of both a straight bar and a curved bar 38 ensures that the accessory can be retrofitted to the two most common maritime anchors—the plow anchor 34 and the claw anchor 36—with precision fitment.

Figure 5:
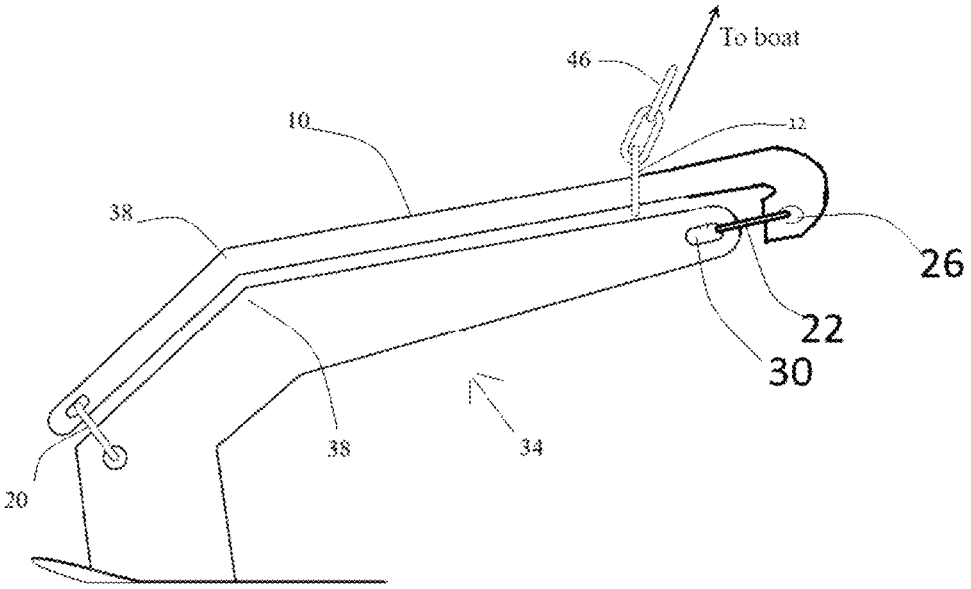
FIG. 5 is a side elevational view of a preferred embodiment of the retrofittable anchor retrieval accessory mounted on a plow anchor, illustrating a hooked distal termination at the second end of the linear bar configured for storage in restricted anchor wells and serving as a mechanical stop for the sliding mount.

Improved Vessel Safety: By facilitating a smoother retrieval process, the invention reduces the strain on the vessel's winch and bow roller, minimizing the risk of mechanical Referring to FIG. 5, a preferred embodiment of the accessory is shown adapted for a plow anchor 34. In this configuration, the second top end of the linear bar 10 defines a downwardly curved or hooked profile. This curvature is specifically engineered to reduce the total longitudinal and vertical footprint of the anchor assembly, ensuring that the anchor and the attached linear bar 10 can fit into an anchor well of restricted size.

As illustrated, the second bar eyelet 26 is positioned within this hooked portion, maintaining the connection via the second shackle 22 to the second shank eyelet 30. This hooked end also serves as a mechanical limit for the sliding mount 12. This design is optimized for single-handed operation, as it permits the anchor to be retrieved and immediately re-deployed without having to reconfigure trip lines or ties.

Figure 6:
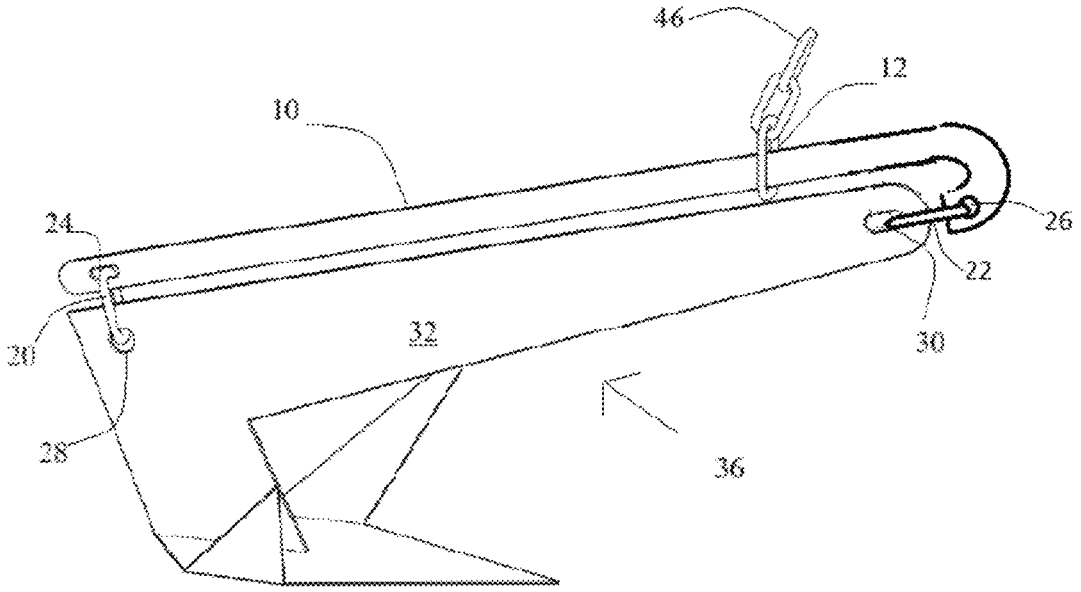
FIG. 6 is a side elevational view of an alternative embodiment of the retrofittable anchor retrieval accessory mounted on a claw anchor, illustrating the second end of the linear bar secured via a shackle to the second shank eyelet, defining a low-profile attachment for confined storage environments.

Referring to FIG. 6, in an alternative embodiment of the accessory, the second bar eyelet 26 of the linear bar 10 is coupled to the second shank eyelet 30 of the anchor 36 via a shackle 22. Unlike the shackle-based connection shown in previous embodiments, the pivot pin assembly 22, which may comprise a through-bolt, clevis pin, or similar rigid fastener, provides a more streamlined interface that significantly reduces the vertical clearance required at the distal end of the shank 32.

This configuration is particularly advantageous for stowage in restricted-size anchor wells where vertical space is at a premium. Furthermore, the shackle 22 acts as a robust mechanical limit for the sliding mount 12, preventing the mount from traveling beyond the second bar eyelet 26 during high-tension retrieval or rapid re-deployment. By providing a more rigid attachment point than a flexible shackle, this embodiment ensures consistent alignment between the linear bar 10 and the anchor shank 32 during single-handed operation.

The embodiments of the retrofittable anchor retrieval accessory described herein are exemplary and numerous modifications, combinations, variations, and rearrangements can be readily envisioned to achieve an equivalent result, all of which are intended to be embraced within the scope of the appended claims. Further, nothing in the above-provided discussions of the retrofittable anchor retrieval accessory should be construed as limiting the invention to an embodiment or a combination of embodiments. The scope of the invention is defined by the description, drawings, and claims.

What is claimed is:

1. An anchor retrieval accessory for attachment to an anchor, the accessory comprising:

a linear bar formed of stainless steel having a first end and a second end, the linear bar defining a first bar eyelet at the first end and a second bar eyelet at the second end;

a plurality of shackles comprising at least a first shackle and a second shackle, the plurality of shackles configured to pivotally couple the first and second bar eyelets to a corresponding pair of shank eyelets disposed on a top side of a shank of the anchor; and a sliding mount movably disposed upon the linear bar, the sliding mount defining a securing point configured to receive a boat rode, wherein the sliding mount comprises a cross-sectional profile that is substantially rectangular or substantially oval;

wherein the anchor is a plow anchor;

wherein the linear bar defines a curvature configured to follow a longitudinal angle of the shank of the plow anchor;

wherein the curvature of the linear bar defines an internal angle of between 90 degrees and 160 degrees; and wherein the second end of the linear bar comprises a hooked distal termination extending toward the anchor shank, the hooked distal termination configured to reduce the profile of the accessory for storage within an anchor well.

2. An anchor retrieval accessory for attachment to an anchor, the accessory comprising:

a linear bar formed of stainless steel having a first end and a second end, the linear bar defining a first bar eyelet at the first end and a second bar eyelet at the second end;

a plurality of shackles comprising at least a first shackle and a second shackle, the plurality of shackles configured to pivotally couple the first and second bar eyelets to a corresponding pair of shank eyelets disposed on a top side of a shank of the anchor; and a sliding mount movably disposed upon the linear bar, the sliding mount defining a securing point configured to receive a boat rode, wherein the sliding mount comprises a cross-sectional profile that is substantially rectangular or substantially oval, wherein the second end of the linear bar comprises a hooked distal termination extending toward the anchor shank, the hooked distal termination configured to reduce the profile of the accessory for storage within an anchor well.

3. The device of claim 2, wherein the linear bar and sliding mount are configured for cyclic re-deployment, such that the anchor is configured to be retrieved and immediately re-deployed without manual reconfiguration of the boat rode.

4. An anchor modification kit, comprising:

a stainless steel linear bar having a cross-section that is substantially flat or circular;

a pair of shackles configured to secure the linear bar to a longitudinal shank of an anchor; and a sliding mount configured to be captivated on the linear bar between the pair of shackles, the sliding mount including an aperture for receiving a winch line, wherein the sliding mount and linear bar are configured such that, during retrieval of the anchor, a point of pull is dynamically shifted along the linear bar to cause the anchor to enter an anchor well in a stowable orientation without manual repositioning of the anchor.

5. The kit of claim 4, wherein the stainless steel linear bar is provided in a curved configuration having an angle between 90 degrees and 160 degrees for use with a plow anchor.

6. The kit of claim 4, wherein the stainless steel linear bar is substantially straight for use with a claw anchor.

7. The kit of claim 4, wherein the sliding mount is rectangular.

8. The kit of claim 4, wherein the sliding mount is oval.

* * * * *